US009647318B2

(12) United States Patent
Grundy

(10) Patent No.: US 9,647,318 B2
(45) Date of Patent: May 9, 2017

(54) MODULAR ANTENNA SYSTEM

(71) Applicant: EchoStar Technologies L.L.C., Englewood, CO (US)

(72) Inventor: Kevin P. Grundy, Fremont, CA (US)

(73) Assignee: EchoStar Technologies L.L.C., Englewood, CO (US)

( * ) Notice: Subject to any disclaimer, the term of this patent is extended or adjusted under 35 U.S.C. 154(b) by 66 days.

(21) Appl. No.: 13/732,065

(22) Filed: Dec. 31, 2012

(65) Prior Publication Data

US 2013/0321232 A1 Dec. 5, 2013

Related U.S. Application Data

(60) Provisional application No. 61/653,312, filed on May 30, 2012.

(51) Int. Cl.

| | |
|---|---|
| ***H01Q 9/44*** | (2006.01) |
| ***H01Q 1/12*** | (2006.01) |
| ***H01Q 7/02*** | (2006.01) |
| ***H01Q 9/18*** | (2006.01) |
| ***H01Q 9/14*** | (2006.01) |

(52) U.S. Cl.

CPC ..... *H01Q 1/1235* (2013.01); *H01Q 7/02* (2013.01); *H01Q 9/14* (2013.01); *H01Q 9/18* (2013.01)

(58) Field of Classification Search

CPC ..... H01Q 11/086; H01Q 1/1235; H01Q 1/10; H01Q 7/02; H01Q 9/14; H01Q 9/18

USPC ..... 343/807, 883, 868, 871, 901, 726, 723, 343/823, 889, 725, 729, 730, 805, 809

See application file for complete search history.

(56) References Cited

U.S. PATENT DOCUMENTS

| | | | | |
|---|---|---|---|---|
| 1,642,350 A * | 9/1927 | Adams | 336/137 |
| D111,982 S | 11/1938 | Kushner | |
| 2,192,187 A * | 3/1940 | Gordon | G01S 1/02 342/385 |
| 2,583,066 A * | 1/1952 | Stiffel | H01Q 1/44 343/721 |

(Continued)

FOREIGN PATENT DOCUMENTS

| | | |
|---|---|---|
| CN | 301176493 | 4/2010 |
| CN | 301245987 | 6/2010 |

(Continued)

OTHER PUBLICATIONS

Boeing E-3 Sentry—Wikipedia, the free encyclopedia, introduction date Mar. 1977, online. Accessed Apr. 25, 2015, 14 pages. Retrieved from: http://en.wikipedia.org/wiki/Boeing_E-3_Sentry.

(Continued)

*Primary Examiner* — Dameon E Levi
*Assistant Examiner* — Hasan Islam
(74) *Attorney, Agent, or Firm* — Kilpatrick Townsend & Stockton LLP

(57) ABSTRACT

A modular reconfigurable indoor antenna is disclosed. The antenna may include a bottom piece, a top piece, and a plurality of vertical members. The top piece may include an Ultra High Frequency (UHF) reception element. The plurality of vertical members may be disposed between the bottom piece and the top piece and coupled therewith. At least one of the plurality of vertical members may include a Very High Frequency (VHF) reception element.

20 Claims, 8 Drawing Sheets

(56) References Cited

U.S. PATENT DOCUMENTS

| | | | | |
|---|---|---|---|---|
| 2,753,557 | A * | 7/1956 | Middlemark | H01Q 1/08 343/702 |
| D208,310 | S | 8/1967 | Patrick | |
| 3,478,361 | A * | 11/1969 | Middlemark | 343/730 |
| D219,592 | S | 12/1970 | Gibbons | |
| D225,283 | S | 11/1972 | Axelrod | |
| 3,831,209 | A | 8/1974 | Clingman | |
| D235,040 | S | 5/1975 | Wright | |
| 3,967,276 | A * | 6/1976 | Goubau | H01Q 9/36 343/752 |
| 4,081,784 | A | 3/1978 | Wilson et al. | |
| D265,442 | S | 7/1982 | Grossman | |
| D274,852 | S | 7/1984 | Withers et al. | |
| 4,475,109 | A * | 10/1984 | Dumas | H01Q 1/081 343/709 |
| D294,895 | S | 3/1988 | Valento | |
| D300,531 | S | 4/1989 | Higgins | |
| D327,690 | S | 7/1992 | Ogawa et al. | |
| D362,470 | S | 9/1995 | Smith | |
| D373,912 | S | 9/1996 | Lladro Roig et al. | |
| D387,771 | S | 12/1997 | Martinson et al. | |
| D398,676 | S | 9/1998 | Marney | |
| D421,439 | S | 3/2000 | Giuntoli | |
| 6,046,706 | A * | 4/2000 | Vargas | 343/883 |
| D525,397 | S | 7/2006 | Wang | |
| D617,319 | S | 6/2010 | Maffetone et al. | |
| 7,764,236 | B2 * | 7/2010 | Hill | H01Q 1/243 343/702 |
| 7,990,332 | B1 * | 8/2011 | Tischer | 343/810 |
| D695,725 | S | 12/2013 | Taeger | |
| 8,736,500 | B1 * | 5/2014 | Lam | H01P 5/10 343/726 |
| D725,714 | S | 3/2015 | Kim | |
| D746,798 | S | 1/2016 | Grundy et al. | |
| 2006/0290583 | A1 | 12/2006 | Forster et al. | |
| 2008/0136723 | A1 | 6/2008 | Tavassoli Hozouri | |
| 2008/0136724 | A1 | 6/2008 | Tavassoli Hozouri | |
| 2012/0056790 | A1 | 3/2012 | Lee et al. | |

FOREIGN PATENT DOCUMENTS

| | | |
|---|---|---|
| GB | 2033569 | 12/1993 |
| JP | D1313829 | 10/2007 |
| KR | 300580935-000 | 12/2010 |

OTHER PUBLICATIONS

"Check out how small this u-blox GPS receiver is!", CoolRC, article date Sep. 8, 2013. Accessed Apr. 25, 2015, 10 pages. Retrieved from: https://coolrc.wordpress.com/2013/09/08/check-out-how-small-this-u-blox-gps-receiver-is/.

Marine Electronics, TV Antennas for boats—google publish date May 5, 2013, online. Accessed Apr. 25, 2015, 20 pages. Retrieved from: http://www.nauticexpo.com/cat/marine-electronics/tv-antennas-boats-WA-1560.html.

Radioshack 15-1892: Indoor Antenna w/RF Remote, blog date Apr. 17, 2007, online. Accessed Apr. 25, 2015, 3 pages. Retrieved from: http://www.missingremote.com/review/radioshack-15-1892-indoor-antenna-w-rf-remote.

U.S. Appl. No. 29/441,124, filed Dec. 31, 2012, Non-Final Office Action mailed May 11, 2015, 63 pages.

U.S. Appl. No. 29/441,124, filed Dec. 31, 2012, Notice of Allowance mailed Aug. 26, 2015, 25 pages.

* cited by examiner

MODULAR ANTENNA SYSTEM

CROSS-REFERENCE TO RELATED APPLICATIONS

This application claims priority to Provisional U.S. Patent Application No. 61/653,312 filed May 30, 2012, entitled "MODULAR ANTENNA SYSTEM," the entire disclosure of which is hereby incorporated by reference, for all purposes, as if fully set forth herein.

BACKGROUND

Receiving television signals from terrestrial broadcasters provides viewers with the lowest cost access to major content programming. As much as fifty percent of all television viewing comes from the major broadcasters. With the introduction of digital video it is now possible for viewers to have access to extraordinary video quality due to MPEG digital encoding. Unfortunately, many viewers do not have antennas to receive digital signals. In the early days of television when the video was encoded in an analog format, reception could be achieved with the use of inexpensive indoor antennas. A popular implementation of indoor antenna, "rabbit ears" provided viewers with a way to optimize reception by adjusting the position of the antenna elements. For UHF frequencies, the user adjusted the position of the loop element. For VHF frequencies, the user would the telescoping antenna elements to a position that would maximize the signal. An example of a "rabbit ears" antenna is provided in FIG. 1.

When television was new and novel, users would not mind the adjusting that came with rabbit ears in order to receive a signal for a particular station. Also, with analog television, it is possible to receive a signal with quite a bit of noise and still watch a show. So, a user with rabbit ears could expect to at least be able to receive and watch shows even if the reception was not perfect. However, with the advent of digital video encoding, it is no longer possible to have a gradual declination of viewing experience.

Today, users are no longer interested in fiddling with antennas to receive television signals. Users expect not only high-quality but high reliability with video reception. With digital television signals, there is no graceful degradation of signal. If the received signal is not sufficient to provide all of the bits to the television, the reception ceases. Not only that, a user has no idea how close to losing reception he/she is during reception. With analog broadcasting, users could easily see how well their positioning of the rabbit ears would affect their viewing.

BRIEF DESCRIPTION

In some embodiments, a modular reconfigurable indoor antenna is provided. The antenna may include a bottom piece, a top piece, and a plurality of vertical members. The top piece may include an Ultra High Frequency (UHF) reception element. The plurality of vertical members may be disposed between the bottom piece and the top piece and coupled therewith. At least one of the plurality of vertical members may include a Very High Frequency (VHF) reception element.

In some embodiments, another modular reconfigurable indoor antenna is provided. The antenna may include a base piece, a top piece, four telescoping vertical members, a UHF reception element, an expandable VHF reception element, a first conductor, and a second conductor. The four telescoping vertical members may be disposed between the base piece and the top piece, where a bottom of each telescoping vertical member is coupled with the base piece and a top of each telescoping vertical member is coupled with the top piece. The UHF reception element may be disposed within the top piece. The first conductor may be in electrical communication with the UHF reception element inside the top piece, extend through at least one of the four telescoping vertical members, and exit the base piece. The expandable VHF reception element may be disposed within base piece, the top piece, and at least two of the four telescoping vertical members. The expandable VHF reception element may expand as the four telescoping vertical members expand. The second conductor may be in electrical communication with the expandable VHF reception element inside the base piece, and exit therefrom.

DETAILED DESCRIPTION

Figure 1:
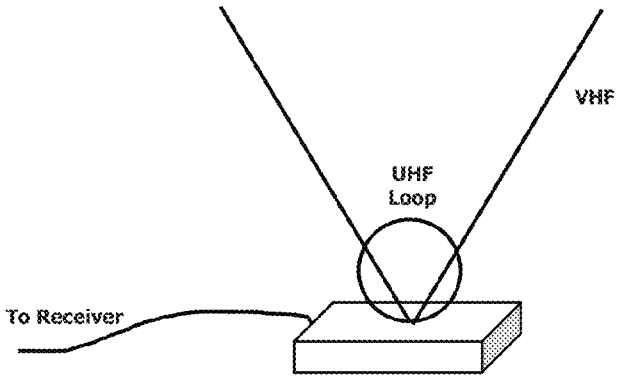
FIGURE 1 (Prior Art)
FIG. 1 is illustrates a relevant prior art typical indoor antenna with a loop for UHF receptions and a movable dipole for VHF reception.

In the following description and in the accompanying drawings, specific terminology and drawing symbols are set forth to provide a thorough understanding of the embodiments described herein. In some instances, the terminology and symbols may imply specific details that are not required to practice the various embodiments. For example, an insulator may be specified as a particular material, such as plastic, but may be any kind of electrically insulating material. Equally, a conductor may be specified as a specific material, such as copper, but may be any combination of materials that allows for electrical conduction. In the following descriptions and accompanying drawings, specific types of antennas are disclosed as examples. Embodiments herein are not limited to a specific antenna configuration or topology. Furthermore, different embodiments may mix different antenna topologies within one implementation. Embodiments can have dipoles, loops, and other arrangements within the same design. Also, embodiments are not limited in quantity as to the number of separate antenna systems allowed. Furthermore, the embodiments do not distinguish between transmission and reception. Although the following descriptions generally describe antenna structures of which their construction is vertical, various embodiments allow for both vertical and horizontal antenna structures. Embodiments do not specify the exact arrangement between multiple antenna elements nor does it specify specific angular relationships between each antenna. To assist in understanding the embodiments, figures include a 3D view, a Top View and an Element View. The 3D view shows overall appearance. The Top View provides the necessary details for illustrating how conductors in Top, Bottom, and Middle pieces are arranged. Although the Top, Bottom, and Middle pieces are shown as rectangular or square, they may be any shape including circular. The Element View shows the conducting elements, thereby exposing the shape of the formed antenna structure. Although the figures show vertical elements that are collinear in their orientation above and below a particular Middle piece, various embodiments allow for vertical elements to be offset, and not collinear, on either side of a Middle piece.

In some embodiments, a modular reconfigurable indoor antenna is provided. The antenna may include a bottom piece, a top piece, and a plurality of vertical members. The top piece may include an Ultra High Frequency (UHF) reception element. The plurality of vertical members may be disposed between the bottom piece and the top piece and coupled therewith. At least one of the plurality of vertical members may include a Very High Frequency (VHF) reception element. The UHF reception element and the VHF reception element may be characterized by any of the configurations discussed herein.

Each of the plurality of vertical members may be extendible between a contracted first state and an extended second state. Any one or more of the plurality of vertical members may biased toward the first state and the second state such that a force necessary to move a vertical member out of the first state or the second state may be greater than the a force necessary to move the vertical member between the first state and the second state. Each of the plurality of vertical members may also extendible to a third state between the first state and the second state. The vertical members may be telescoping, or otherwise configurable to accomplish a change between states. In yet other embodiments, the plurality of vertical members may be rigid and not extend/retract from a fixed state.

The electrical characteristics of the VHF reception element may be different in the first state than in the second state. Likewise, the electrical characteristics of the VHF reception element may be different in the third state than in the first state or the second state.

In some embodiments, the UHF reception element may include a bow-tie shaped or other shaped element(s). In these or other embodiments, the VHF reception element may include a loop or other shaped element(s). Such a loop element may be disposed within the bottom piece, at least two of the plurality of vertical members, and the top piece. The height of the loop element may be adjusted by extending or contracting each of the plurality of vertical members between the first, second, and third states.

The UHF reception element may be electrically coupled with a conductor extending through at least one of the plurality of vertical members and exiting the bottom piece. Likewise, the VHF reception element may be electrically coupled with another conductor exiting the bottom piece. These conductors may couple the antenna with a display device or other receiver, thereby allowing transmission of signals received by the UHF and VHF reception elements for eventual viewing on a display device.

In some embodiments, another modular reconfigurable indoor antenna is provided. The antenna may include a base piece, a top piece, four telescoping vertical members, a UHF reception element, an expandable VHF reception element, a first conductor, and a second conductor. The four telescoping vertical members may be disposed between the base piece and the top piece, where a bottom of each telescoping vertical member is coupled with the base piece and a top of each telescoping vertical member is coupled with the top piece. The UHF reception element may be disposed within the top piece. The first conductor may be in electrical communication with the UHF reception element inside the top piece, extend through at least one of the four telescoping vertical members, and exit the base piece. The expandable VHF reception element may be disposed within base piece, the top piece, and at least two of the four telescoping vertical members. The expandable VHF reception element may expand as the four telescoping vertical members expand. The second conductor may be in electrical communication with the expandable VHF reception element inside the base piece, and exit therefrom.

Figure 2:
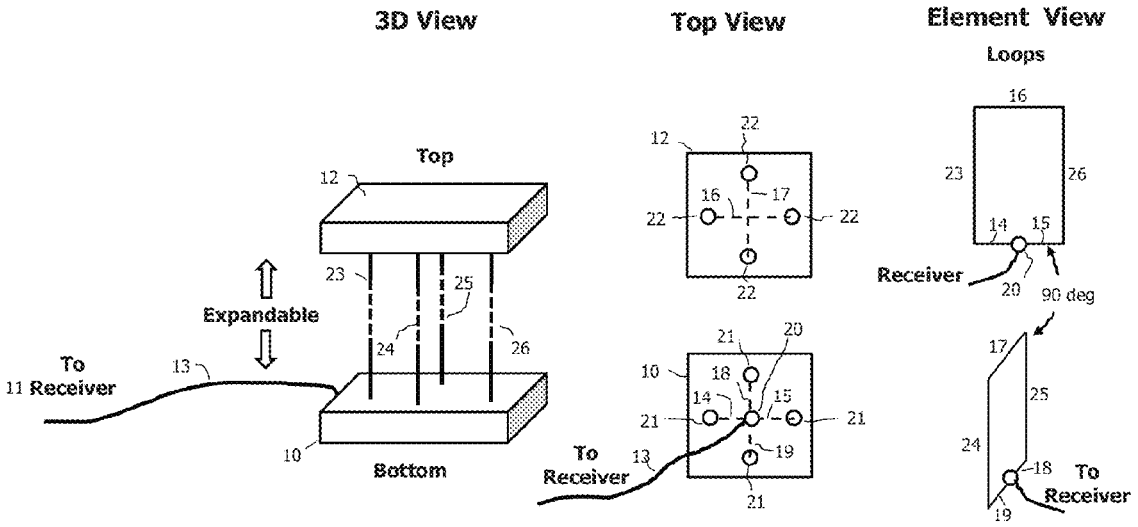
FIG. 2 is an illustration of an embodiment of a modular dual-loop antenna with a Top and Bottom.

FIG. 2 illustrates an embodiment comprising a dual vertical loop antenna system created by the use of Top 12 and Bottom 10 insulating platforms and separate conductive elements. In this embodiment, each loop is arranged such that they are orthogonal to each other, though different spatial arrangements are possible in other embodiments. A first loop is formed by conductors 14, 15 in the Bottom 10, conductors 23, 26 attached to the Bottom conductors and to Top 12 conductor 16. The vertical conductors 23, 26 may be made of metal or any other material capable of electrical conduction. This includes, but is not limited to metal tubes, metal rods, metal bars, metal plates, or polymer rods coated with electrical conductive material. The shape of vertical conductors 23, 26 is not limited to a straight line. Other shapes that deviate from a straight line are allowed. When a straight line conductor is used for vertical elements 23, 26, they may allow for telescoping or otherwise allow for extension and/or contraction by other means. In some embodiments vertical elements 23, 26 may be of a fixed length and/or arrangement. Consequently, the entire dual vertical loop antenna can be made to increase in height to allow for varied performance. The formed loop of conductive elements 14, 23, 16, 26, 15 is attached to a cable 13 through a cable connection point 20. Conductive elements 23 and 24 are attached to Top 12 and Bottom 10 through attachment points 22. Although these attachment points 22 are shown as circles, the particular shaped used in any embodiment could vary, possibly to match the cross section of conductive elements 23, 24, 25, 26. Conductor 16 in Top 12 is shown as crossing conductor 17, but may or may not electrically connect the two loops. Conductors 14, 15, 16 in Bottom 10 and Top 12 may be made from metal or other material capable of electrical conduction. This includes, but is not limited to metal tubes, metal rods, metal bars, metal plates, metal foil, metal paint, polymer rods coated with electrical conductive material, or wires. Similar to the first loop, a second loop is formed by conductors 18, 19 in Bottom 10, and conductors 24, 25 attached to the Bottom conductors and to Top 12 conductor 17. The second loop is also connected to cable 13 through a cable connection point 20.

Figure 3:
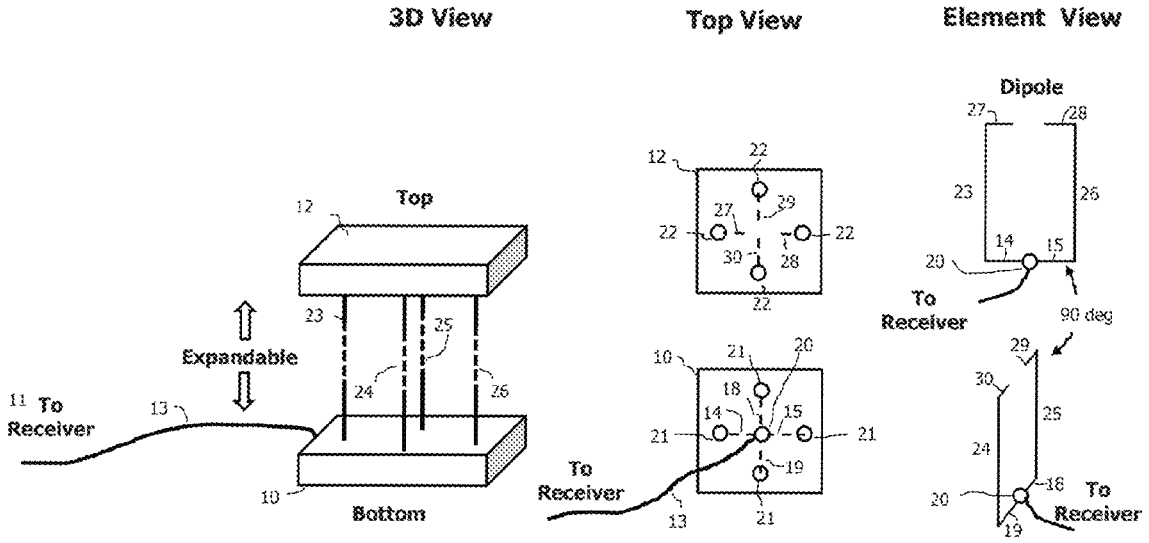
FIG. 3 is an illustration of an embodiment of a modular dual-dipole antenna with a Top and Bottom.

FIG. 3 illustrates an embodiment comprising a dual vertical dipole antenna system similar to the one shown in FIG. 2. The construction of a dipole is identical to that of the loop except that in the Top 12, conductors 16, 17 have been replaced with conductors 27, 28, 29, 30. For the first loop, conductors 27, 28 extend the length of vertical conductors 23, 26 respectively. However, there is no connection between conductors 27, 28 thereby configuring the antenna as a dipole and not a loop. Similarly, for the second loop, conductors 29, 30 extend the length of the vertical conductors 25, 24 respectively. As shown by FIGS. 2 and 3, configuring between differing types of antennas is easily accomplished by the use of different connections within Top 12 or Bottom 10 structures.

Figure 4:
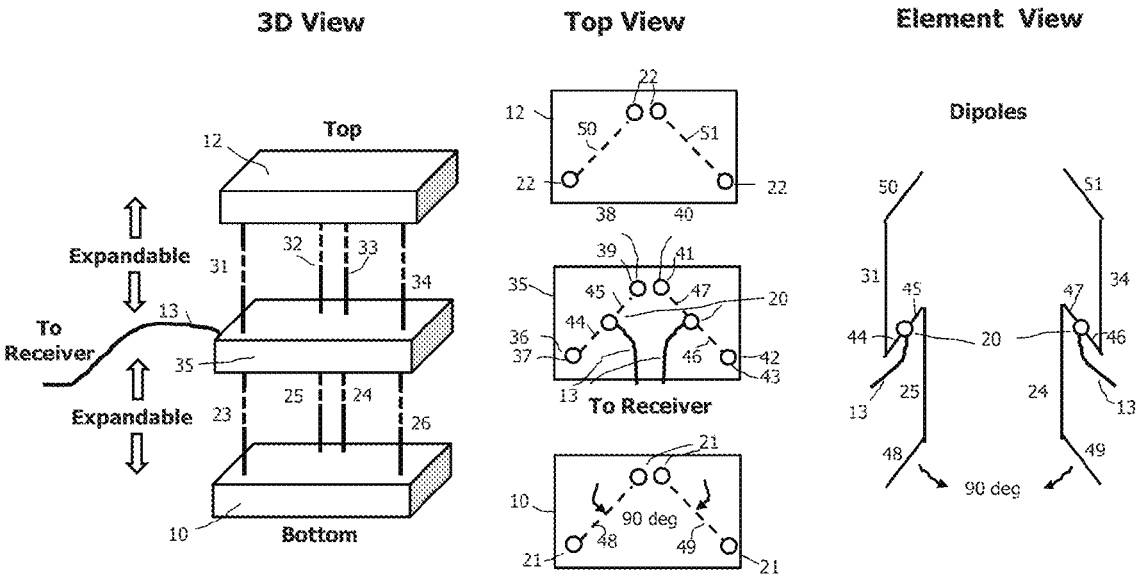
FIG. 4 is an illustration of an embodiment of a modular dual-dipole antenna with a Top, Middle and Bottom.

FIG. 4 illustrates an embodiment comprising a dual vertical dipole. Unlike the dipole in FIG. 3, the dipole in FIG. 4 makes use of additional horizontal routing distance through the introduction of a Middle 35 insulating platform. This additional horizontal routing capability may enable the overall design of the entire structure to lessen its overall height thereby possibly supporting longer wavelengths with a shorter structure. Middle 35 has attach points for vertical elements on both its top and bottom surfaces. Bottom attach points, 36, 38, 40, 42 provide for attachment of vertical elements rising from Bottom 10. Top attach points, 37, 39, 41, 43 provide for attachment of vertical elements descending down from, Top 12. Not all of vertical elements 23, 24, 25, 26, 31, 32, 33, 34 may be electrically conductive. To implement the dual dipoles, elements 23, 26, 32, 33 may be made non-conductive whereas elements 24, 25, 31, 34 may remain conductive. Attach points 21, 22, 36, 37, 38, 39, 40, 41, 42, 43 may be either electrically conducting or insulating to facilitate the formation of various antenna topologies while leaving all vertical elements conductive. For the dual dipole shown in FIG. 4 attach points associated with vertical elements 23 (36 and Bottom 21), 26 (42 and Bottom 21), 32 (39 and Top 22), and 33 (41 and Top 22) may be made non-conductive. A first dipole may be formed by conductive elements 48, 25, 45, 44, 31, 50. A second dipole may be formed by conductive elements 49, 24, 47, 46, 34, 51.

Figure 5:
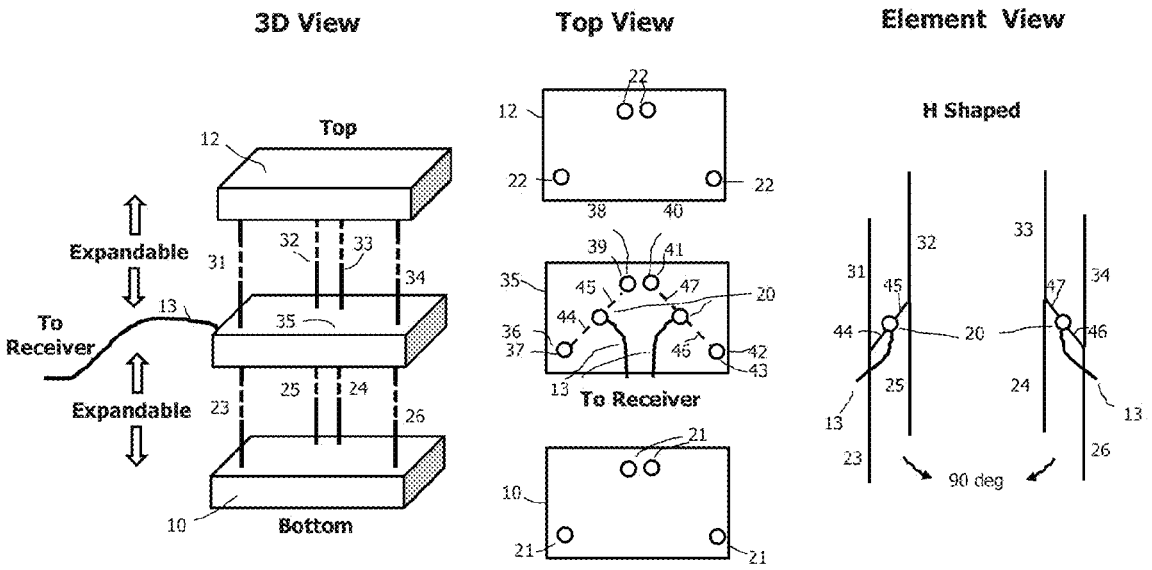
FIG. 5 is an illustration of an embodiment of a modular dual-H antenna with a Top, Middle and Bottom.

FIG. 5 illustrates an embodiment comprising a dual H antenna similar to the structure in FIG. 4. In this embodiment, all vertical elements 23, 24, 25, 26, 31, 32, 33, 34 are conductive. However, Bottom 10 and Top 12 have had their horizontal conductors 48, 49, 50, 51 removed. Alternatively, attach points 21, 22 for each of vertical conductors 23, 24, 25, 26, 31, 32, 33 and 34 on Bottom 10 and Top 12 may be made non-conductive.

Figure 6:
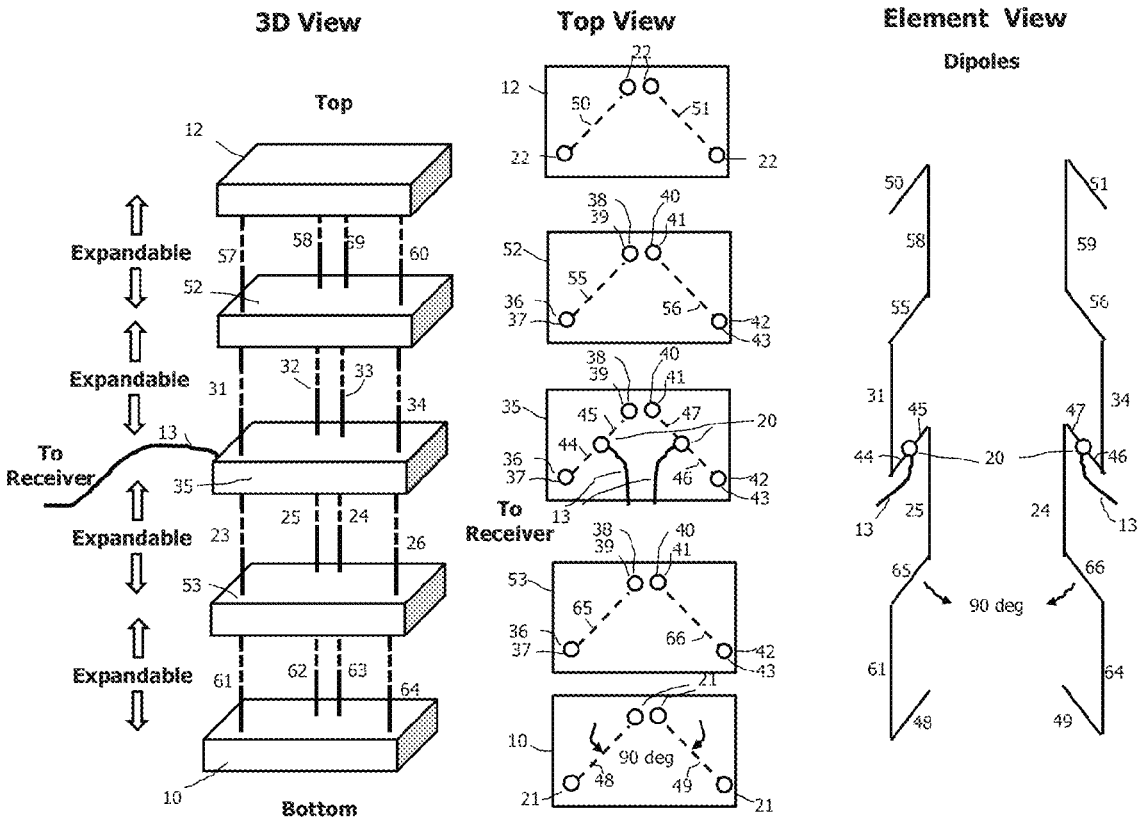
FIG. 6 is an illustration of an embodiment of a modular dual dipole antenna with a Top, three Middle sections and a Bottom.

FIG. 6 illustrates an embodiment comprising a dual dipole similar to FIG. 4 with the addition of two more Middle pieces 52, 53. The added horizontal routing may substantially reduce the need for vertical height. Conductive vertical elements may include vertical elements 61, 25 31, 58, 64, 24, 34, 59. Non-conductive vertical elements may include vertical elements 23, 57, 26, 60. The first dipole is comprised of conductive elements 48, 61, 65, 25, 45, 44, 31, 55, 58, 50. The second dipole is comprised of conductive elements 49, 64, 66, 24, 47, 46, 34, 56, 59, 51.

Figure 7:
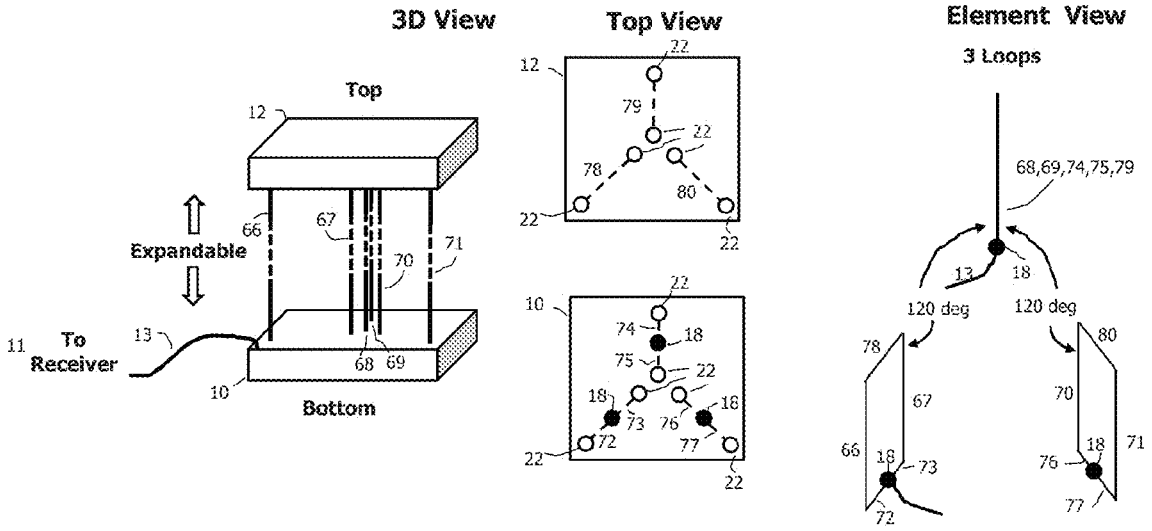
FIG. 7 is an illustration of an embodiment of a modular triple loop antenna with a Top and Bottom.

FIG. 7 illustrates an embodiment comprising a triple loop similar to that shown in FIG. 2. In this embodiment, instead of two loops arranged at 90 degrees, there are three loops arranged at 120 degrees. The first loop is comprised of conductive elements 72, 66, 78, 67, 73. The second loop is comprised of conductive elements 76, 70, 80, 71, 77. The third loop is comprised of conductive elements 68, 69, 74, 75, 79. Although the first, second and third loops do not cross each other in the illustrated embodiment, in other embodiments the loops could cross each other as in the embodiment shown in FIG. 2.

Figure 8:
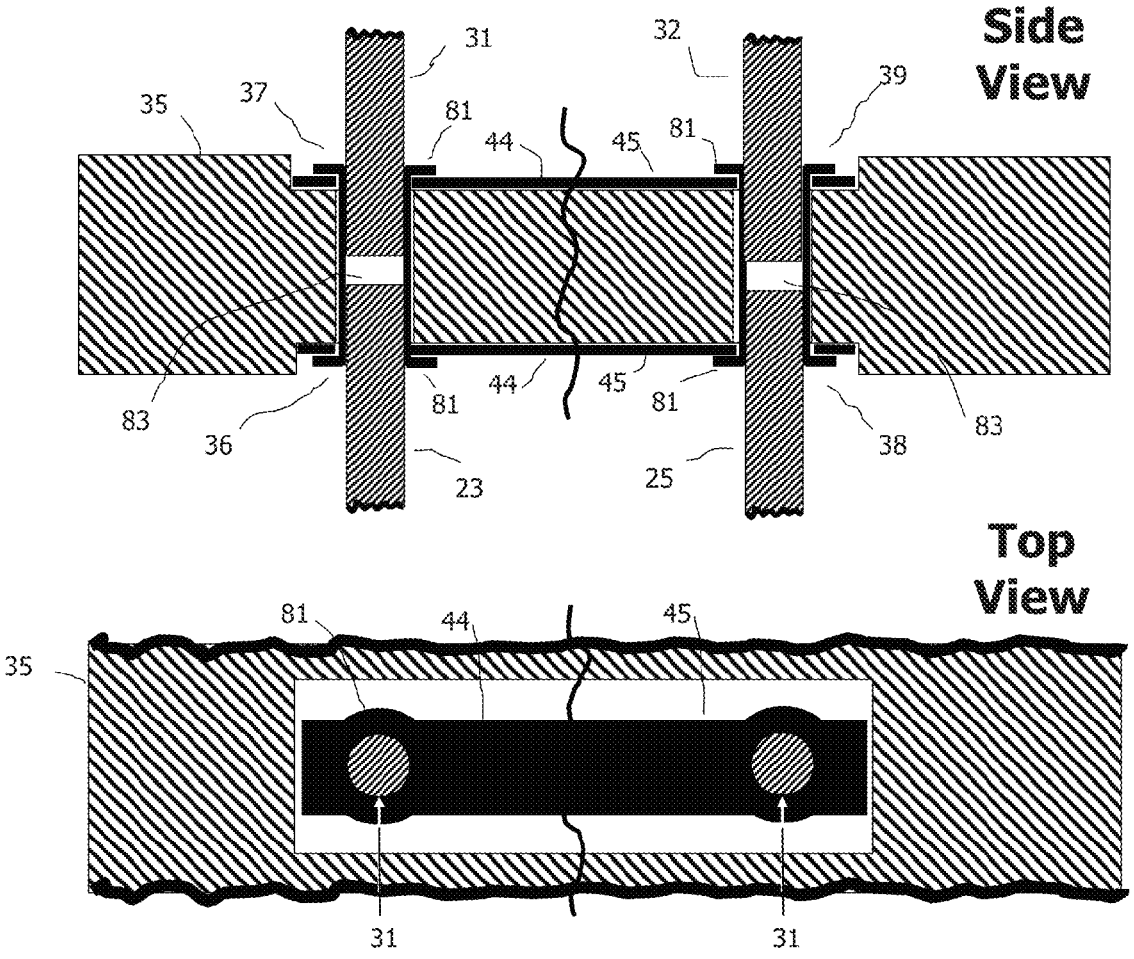
FIG. 8 is an illustration of stacking attached antenna vertical elements.

FIG. 8 illustrates an embodiment comprising a vertical element attachment method for Middle pieces 35, 52, 53. In this embodiment, coarse crosshatching represents non conducting insulating material, fine cross hatching represents conductive vertical elements 23, 25, 31, 32 and black shading represents conductive metal such as copper overlaid and attached to the non-conducting material of Middle pieces 35, 52, 53. Furthermore, FIG. 8 references elements described in FIG. 5 for a dual H shaped antenna system. In this embodiment, the Middle 35 is constructed of a non-conducting material (e.g. polymer). Also, in this embodiment, the vertical conductive elements are circular in shape (other embodiments may use other shapes). Holes 83 are made in Middle 35 which will accept vertical conductive elements. On the surface of Middle 35, copper is deposited to provide for a conductive pathway to form elements 44 and 45 as specified in FIG. 5. To strengthen the connection and to protect the hole made in the non-conductive material, a metal casing 81 with a flange is installed over the copper and lines holes 83. Vertical elements 23, 25, 31, 32 are inserted into metal casing 81 from both the top and bottom of Middle 35. When inserted, elements 23, 31, 44 may thus be electrically connected. In addition, elements 25, 32, 45 may also be connected in this fashion.

Figure 9:
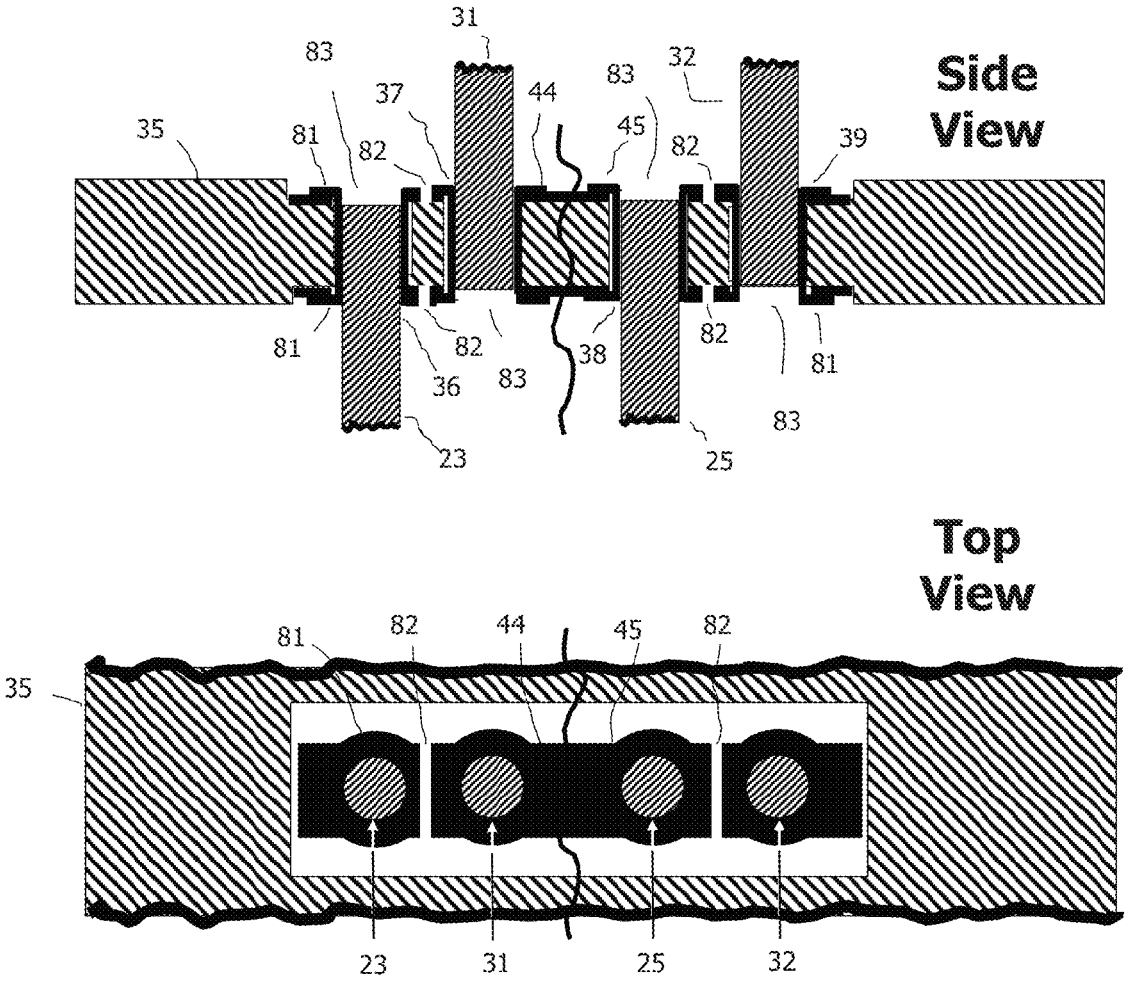
FIG. 9 is an illustration of offset attached antenna vertical elements.

FIG. 9 illustrates an embodiment comprising a vertical element attachment system for Middle pieces 35, 52, 53. This embodiment provides for the electrical isolation of vertical elements. Unlike the embodiment of FIG. 8, there are four 83 holes made in the Middle 35. This allows for offsetting of vertical elements which provides for electrical isolation. FIG. 9 references elements described in FIG. 4 for a dual dipole antenna system. As with FIG. 9, coarse crosshatching represents non conducting insulating material, fine cross hatching represents conductive vertical elements 23, 25, 31, 32 and black shading represents conductive metal such as copper overlaid and attached to the non-conducting material of Middle 35. As FIG. 4 illustrates, vertical elements 23, 31 are electrically isolated, as are vertical elements 25, 32. In this embodiment, isolation is enabled by offsetting their attachment points. Top attachment points 37, 39 are offset from Bottom attachment points 21. Although vertical element 23 is connected into a hole 83 encased with a metal casing 81, a gap 82 in the metal conductor on the surface of Middle 35 ensures electrical isolation. Vertical conductive element 31 is electrically connected to element 44 through its metal casing 81.

The foregoing figures and descriptions describe embodiments of a modular system of antenna construction which may be flexible, compact, and inexpensive to manufacture. Tops 12, Middles 35, and Bottoms 10 may be easily and inexpensively produced from plastic injection molding. Such an injection molded part could have a variety of pre-defined attached points and horizontal channels allowing for easy configuration of conductive elements to quickly produce many varieties of antenna systems. If reduced height is desired, more Middle sections may be added thereby providing more antennal length in the horizontal direction. Various embodiments may also allow for customization for frequency, as the length of the vertical antenna elements may be easily adjusted. The length of these elements may be fixed at manufacturing time, or alternatively, the vertical antenna elements may be constructed from telescoping materials to allow for end user adjustment.

What is claimed is:

1. A modular reconfigurable indoor antenna, wherein the antenna comprises:

a bottom piece;

a top piece; and a plurality of vertical members, wherein:

each of the plurality of vertical members is disposed between the bottom piece and the top piece;

each of the plurality of vertical members is coupled with the top piece, and coupled with the bottom piece;

a first subset of the plurality of vertical members is electrically connected by a first length of a conductive element embedded within the bottom piece, thereby forming a first Very High Frequency (VHF) reception element comprising the first subset of the vertical members and the first length of the conductive element;

a second subset of the plurality of vertical members, each of which is separate from the first subset of the vertical members, is electrically connected by a second length of a conductive element embedded within the bottom piece, thereby forming a second Very High Frequency (VHF) reception element comprising the second subset of the vertical members and the second length of the conductive element, wherein the first VHF reception element and second VHF reception element are arranged at different angles, and wherein the first length of the conductive element and the second length the conductive element are electrically connected within the bottom piece; and wherein each of the plurality of vertical members is extendible between a contracted first state and an extended second state.

2. The modular reconfigurable indoor antenna of claim 1, wherein: electrical characteristics of the first VHF reception element and the second VHF reception element are different in the first state than in the second state.

3. The modular reconfigurable indoor antenna of claim 1, wherein: each of the plurality of vertical members is extendible to a third state between the first state and the second state.

4. The modular reconfigurable indoor antenna of claim 3, wherein: electrical characteristics of the first VHF reception element and the second VHF reception element are different in the third state than in the first state or the second state.

5. The modular reconfigurable indoor antenna of claim 1, wherein the first VHF reception element comprises a first loop element, and the second VHF reception element comprises a second loop element.

6. The modular reconfigurable indoor antenna of claim 5, wherein the first loop element and the second loop element are each disposed within the bottom piece, at least two of the plurality of vertical members, and the top piece.

7. The modular reconfigurable indoor antenna of claim 6, wherein: a height of the first loop element and a height of the second loop element are adjusted by extending or contracting each of the plurality of vertical members.

8. The modular reconfigurable indoor antenna of claim 1, wherein: each of the first VHF reception element and the second VHF reception element is electrically coupled with a conductor exiting the bottom piece.

9. The modular reconfigurable indoor antenna of claim 1, wherein the first VHF reception element comprises a first loop element formed by two of the plurality of vertical members and conductors within the bottom piece and the top piece, and wherein the first VHF reception element is arranged at a 90 degree angle to the second VHF reception element comprising a second loop element formed by two others of the plurality of vertical members and conductors within the bottom piece and the top piece.

10. The modular reconfigurable indoor antenna of claim 9, wherein the first VHF reception element and the second VHF reception element are electrically coupled to a cable at a same cable connection point.

11. The modular reconfigurable indoor antenna of claim 1, wherein the first VHF reception element comprises a first dipole element formed by two of the plurality of vertical members and conductors within at least one of the bottom piece or the top piece, and wherein the first VHF reception element is arranged at a 90 degree angle to the second VHF reception element comprising a second dipole element formed by two others of the plurality of vertical members and conductors within at least one of the bottom piece or the top piece.

12. The modular reconfigurable indoor antenna of claim 11, wherein the first VHF reception element and the second VHF reception element are electrically coupled to a cable at a same cable connection point.

13. The modular reconfigurable indoor antenna of claim 1, wherein the top piece comprises an Ultra High Frequency (UHF) reception element.

14. The modular reconfigurable indoor antenna of claim 13, wherein the UHF reception element comprises a bow-tie shaped UHF reception element.

15. The modular reconfigurable indoor antenna of claim 1, wherein the bottom piece comprises a first horizontal insulating platform, wherein the top piece comprises a second horizontal insulating platform, and wherein the antenna further comprises:

a middle piece comprising a third horizontal insulating platform, wherein the middle piece is positioned between the bottom piece and the top piece, and wherein the middle piece is coupled to each of the plurality of vertical members.

16. The modular reconfigurable indoor antenna of claim 1, wherein the first reception element and the second reception element are arranged orthogonal to each other.

17. A modular reconfigurable antenna, comprising:

a bottom piece comprising a first horizontal insulating platform;

a top piece comprising a second horizontal insulating platform;

a middle piece positioned between the bottom piece and the top piece comprising a third horizontal insulating platform; and a plurality of vertical members, wherein:

each of the plurality of vertical members is disposed between the bottom piece and the top piece;

each of the plurality of vertical members is coupled with the top piece, coupled with the bottom piece, and coupled with the middle piece;

a first subset of the plurality of vertical members is electrically connected by a first length of a conductive element embedded within the bottom piece, thereby forming a first Very High Frequency (VHF) reception element comprising the first subset of the vertical members and the first length of the conductive element; and a second subset of the plurality of vertical members, each of which is separate from the first subset of the vertical members, is electrically connected by a second length of a conductive element embedded within the bottom piece, thereby forming a second Very High Frequency (VHF) reception element comprising the second subset of the vertical members and the second length of the conductive element, wherein the second length of the conductive element is embedded within the bottom piece at an angle perpendicular to the first length of the conductive element embedded within the bottom piece.

18. A modular reconfigurable antenna, comprising:

a bottom piece;

a top piece; and a plurality of vertical members, wherein:

each of the plurality of vertical members is disposed between the bottom piece and the top piece;

each of the plurality of vertical members is coupled with the top piece, and coupled with the bottom piece;

a first subset of the plurality of vertical members is electrically coupled to one or more lengths of a conductive element embedded within at least the bottom piece or the top piece, to form a first Very High Frequency (VHF) reception element; and a second subset of the plurality of vertical members is electrically coupled to one or more additional lengths of a conductive element embedded within at least the bottom piece or the top piece, to form a second Very High Frequency (VHF) reception element, wherein the first VHF reception element and the second VHF reception element are arranged orthogonal to each other.

19. The modular reconfigurable antenna of claim 18, wherein the combination of the first VHF reception element and the orthogonal second VHF reception element forms a dual vertical dipole antenna system.

20. The modular reconfigurable antenna of claim 18, wherein the combination of the first VHF reception element and the orthogonal second VHF reception element forms a dual H antenna system.

* * * * *